United States Patent [19]

Müller

[11] Patent Number: 4,831,607

[45] Date of Patent: May 16, 1989

[54] WATCH CASE WITH GLASS-TO-METAL SEAL

[75] Inventor: Jacques Müller, Reconvilier, Switzerland

[73] Assignee: ETA SA Fabriques d'Ebauches, Granges, Switzerland

[21] Appl. No.: 116,925

[22] Filed: Nov. 4, 1987

[30] Foreign Application Priority Data

Nov. 4, 1986 [CH] Switzerland ..... 04364/86

[51] Int. Cl.[4] ..... G04B 37/00

[52] U.S. Cl. ..... 368/309; 368/281; 368/299

[58] Field of Search ..... 368/276, 280–282, 368/291, 299, 294–296, 300, 309

[56] References Cited

U.S. PATENT DOCUMENTS

| | | | |
|---|---|---|---|
| 2,968,911 | 1/1961 | Piquerez | 368/291 |
| 3,796,042 | 3/1974 | Finger | 368/291 |
| 4,479,724 | 10/1984 | Matsumoto et al. | 368/291 |
| 4,522,508 | 6/1985 | Meister | 368/276 |
| 4,623,262 | 11/1986 | Gogniat et al. | 368/296 |
| 4,626,108 | 12/1986 | Ganter | 368/309 |

*Primary Examiner*—Bernard Roskoski

*Attorney, Agent, or Firm*—Sughrue, Mion, Zinn, Macpeak, and Seas

[57] ABSTRACT

The case is essentially made up of a hollow middle cum glass unit (1), consisting of an integral glass pressing, and of a metal back (10) closing off a cavity (5) defined by the inside surface of the hollow unit, the cavity providing a housing for a movement.

In the cavity is mounted a metal ring (15) having a centering flange (16) bearing against the middle portion of the unit. In the space between the ring and the middle portion are inserted a deformable rubber gasket (19) and a metal annulus (18) whose radially outer surface is formed with a bevel (18') in the region nearest the gasket.

Screws (20) secure the back (10) to the ring (15) and press it against the annulus (18). On being driven home, the screws wedge the bevel (18') between the gasket and the ring thereby to apply a radial force on the gasket . This force presses the gasket against the middle portion of the unit and prevents it from moving out of the cavity.

14 Claims, 1 Drawing Sheet

WATCH CASE WITH GLASS-TO-METAL SEAL

BACKGROUND OF THE INVENTION

1. Field of the Invention

This invention relates to a watch case of the kind comprising a middle cum glass unit having a central transparent portion and a peripheral side portion together defining an inner cavity for accommodating a movement, a back that closes off the cavity, and assembly means for securing the back to the unit.

The invention is more particularly, but not exclusively, concerned with a water resistant case in which the middle cum glass unit is an integral component made of mineral glass, and the back is made of metal.

2. Prior Art

Watch cases of this kind are well known. Yet, despite their simplicity, they have never been used to any great extent because the assembly of the two parts has always given rise to a delicate problem that has never satisfactorily been resolved.

For instance, German Patent Specification No. 3120799 describes a watch case in which the middle cum glass unit, made of pressed glass, and the back, made of metal, are assembled by means of a snapping arrangement acting directly between these two parts. Clearly, such an arrangement is likely to damage or even break the part made of glass when opening and closing the case.

An assembly arrangement not likely to cause such damage is used in the watch case described in Swiss patent specification No. 554014. The middle cum glass unit of this case is made of sintered corundum, a hard and brittle material, and the back is made of steel. The two parts are here assembled with screws extending through holes in the back and driven into metal plugs secured in holes in the middle cum glass unit. Whereas this assembly arrangement does help to avoid high local pressures, it is however expensive to put into practice as it involves having to drill holes in a material that is difficult to machine and having to fit the plugs.

SUMMARY OF THE INVENTION

An object of the invention is to overcome these drawbacks by providing a watch case of the kind set forth which further comprises a deformable gasket along the inner surface of the side portion and in which the assembly means project, at least partly, into the cavity to exert, in cooperation with the back, a radial force on the gasket thereby to compress it against said inner surface.

One advantage of the watch case according to the invention is due to the fact that the deformable gasket, by evenly distributing the pressures being exerted on said inner surface, avoids any risk of local deformation liable to break the middle cum glass unit.

Another advantage of the invention resides in the simplicity of the assembly means which, by requiring neither tricky machining operations nor complex parts, enables the cost price of the case to be reduced.

BRIEF DESCRIPTION OF THE DRAWINGS

In the accompanying drawings, given by way of example.

Figure 2:
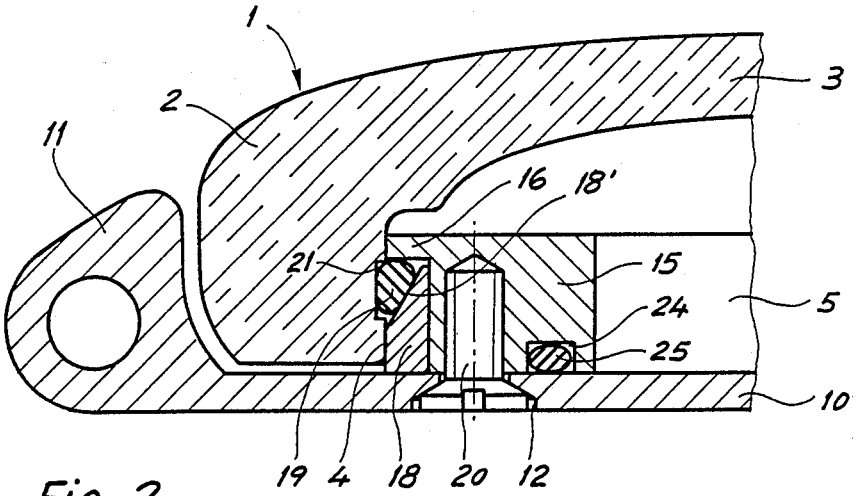
FIG. 2 is a view similar to that of FIG. 1 showing the same components once assembled.
Figure 1:
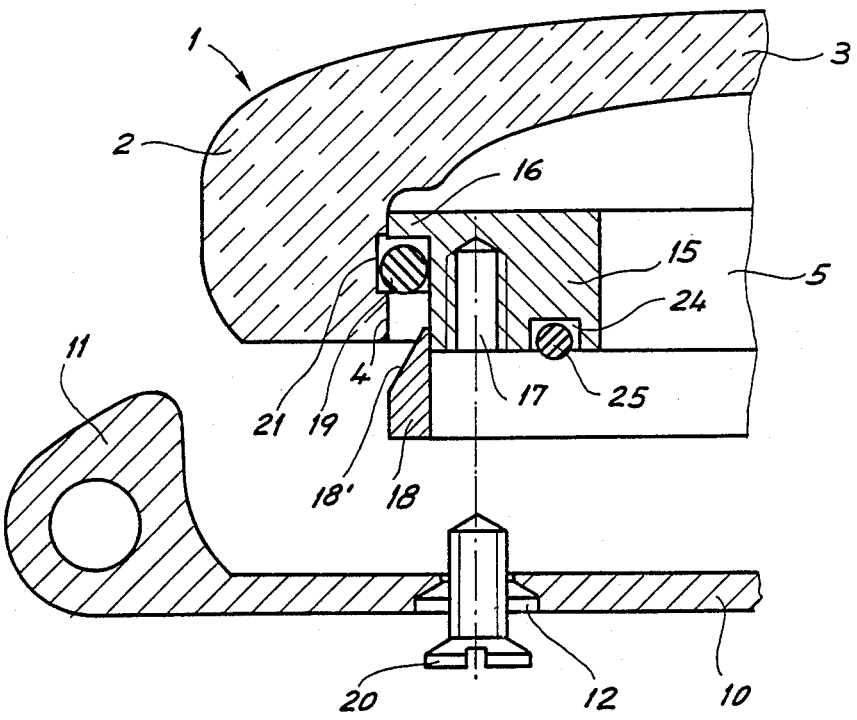
FIG. 1 is a partial, cross-sectional side view of a watch case according to the invention showing its main components in the process of being assembled.

The watch case shown in FIGS. 1 and 2 comprises, as one of its two main components, a middle cum glass unit 1 of circular shape. Unit 1 has a relatively thick edge portion 2 and a central, thinner, dome-like portion 3. Preferably, unit 1 is made of pressed mineral glass. It thus forms a single homogeneous part. Edge portion 2 performs the same function as a middle in a traditional watch and dome-like portion 3, which is transparent, performs the same function as a glass in such a watch. The outer surface of edge portion 2 may suitably be treated to impart thereto a particular appearance. This surface may for instance be made opaque to remove from view the interior of the watch case.

Edge portion 2 has an inner, side surface 4 which, in conjunction with the inside surface of dome-like portion 3, defines in unit 1 an internal cavity 5. Cavity 5 is designed to accommodate a movement and display means, not shown. Surface 4 is cylindrical and lies at right angles to the main plane of the watch case.

Opposite dome-like portion 3, unit 1 cooperates with a back 10, this being the other main component of the watch case. Back 10 essentially consists of a thin plate made for instance of stainless steel, designed to close off cavity 5, and is formed, at opposite ends, with two pairs of integral horns 11 to which may be fastened a wristlet not shown and, in the thin plate portion, with holes 12 which have axes parallel to surface 4 and which will be described later.

Inside unit 1 is located a brass ring 15 formed at its end facing dome-like portion 3 with a radial flange 16. The outer edge of flange 16 engages surface 4 thereby radially to center ring 15 in cavity 5. Ring 15 may usefully act as a fitting ring for the movement. Ring 15 is formed also with tapped holes 17 opposite holes 12.

Around ring 15, in the free space that separates it from surface 4, a brass annulus 18 extends from flange 16 to the lower end of ring 15. The radially outer surface of annulus 18 is formed with a bevel 18′ over a portion thereof nearest flange 16.

In the space bounded by surface 4, ring 15, flange 16 and the bevel 18′ of annulus 18, is housed a deformable annular gasket 19. Gasket 19 is made of a material softer than that used for ring 15 and annulus 18. For instance, if ring 15 and annulus 18 are made of steel or brass, gasket 19 may be made of rubber, a synthetic material or possibly a ductile metal such as copper.

The above described parts 15, 18 and 19 may slide freely in an axial direction along surface 4. They may thus readily be inserted into and removed from cavity 5.

The foregoing description is that of a round watch case. The teachings provided by this form of embodiment may of course be applied to a watch case of, for instance, rectangular or oval shape.

To assemble the watch case, gasket 19 is first slipped over ring 15 until it engages flange 16, annulus 18 is then slipped over ring 15 till bevel 18′ engages gasket 19 and the resulting sub-assembly is then inserted into cavity 5. The height of annulus 18 is such that, at this stage, its outer end projects beyond both unit 1 and ring 15.

Back 10 is thereupon applied against annulus 18 in a position such that holes 12 register with holes 17 and a screw 20 is inserted through each hole 12 and driven home in the associated hole 17. In so doing, back 10 moves closer to ring 15 and exerts an axial force on annulus 18. This force, which is directed perpendicularly to back 10, causes the bevel 18′ of annulus 18 to be wedged between ring 15 and gasket 19 and the latter to be deformed since it bears on flange 16. With sufficient wedging from annulus 18 gasket 19 engages surface 4 against which it is pressed by a radial force. Since gasket 19 is deformable, the pressure it exerts on surface 4 is uniformly distributed thereby avoiding local deformations liable to break unit 1 if it is made of hard and brittle material.

The radial force that presses gasket 19 against surface 4 increases the coefficient of static friction between the two, thereby preventing ring 15 from moving out of cavity 5. The height or axial length of annulus 18 and the slope of bevel 18' are so selected that when back 10 engages ring 15 after driving home screw 20 the static friction between surface 4 and gasket 19 is sufficient to avoid accidental opening of the watch case. To improve still further the securing of back 10 to unit 1, surface 4 may with advantage be roughened or be formed with a gasket receiving groove 21 where gasket 19 engages surface 4.

Deformable gasket 19 may form a seal to prevent moisture from entering cavity 5 along surface 4. However, for the watch case to be properly water-resistant, a second sealing gasket 25 is provided between back 10 and ring 15 in a groove 24 formed in ring 15. Screws 20 are located radially beyond groove 24 which may of course also be formed in back 10.

The watch case described above may be modified in a variety of ways within the scope of the appended claims. For instance, unit 1 may comprise a middle, a glass and possibly a bevel that are separate, these independent parts being assembled in conventional manner. The middle is then preferably made of a hard material such as sintered metal, corundum or ceramic, but a metal such as brass, stainless steel or gold may also be used. Side surface 4, for securing back 10, would be provided in the middle. In another modification, surface 4 may be provided in the glass which would then have to this end a thick edge portion, the height of the middle being then reduced so as not to add to the height of the case.

I claim:

1. A watch case comprising a middle cum glass unit having a central transparent portion and a peripheral side portion together defining an inner cavity for accommodating a movement, a back that closes off the cavity, assembly means for securing the back to the unit, and a deformable gasket along the inner surface of the side portion, said assembly means projecting, at least in part, into the cavity to exert, in cooperation with the back, a radial force on the gasket thereby to compress the latter against said inner surface; wherein said assembly means include:

a ring disposed in the cavity and leaving a free space between itself and said inner surface, said ring having a centering flange bearing on said inner surface and forming a bearing for the gasket;

an annulus disposed in said free space and having a radially outer surface formed with a bevel over a portion thereof nearest the gasket; and means for securing the back to the ring whereby the back may exert on the annulus an axial force such that its bevel, in cooperation with the flange, may exert said radial force on the gasket and compress the latter against said inner surface.

2. A watch case as in claim 1, where the back provides a fitting ring for said movement.

3. A watch case as in claim 2, wherein said gasket is a sealing gasket.

4. A watch case as in claim 3, further comprising a sealing gasket between the back and the ring.

5. A watch case as in claim 2, wherein the middle cum glass unit is a single part made of pressed mineral glass.

6. A watch case as in claim 2, wherein said inner surface has a circumferential groove for receiving said deformable gasket.

7. A watch case as in claim 1, wherein the means for securing the back to the ring include at least one screw.

8. A watch case comprising: a middle cum glass unit (1) having a central transparent portion (3); a peripheral side portion having an inner surface and an outer surface, said inner surface defining together with said central portion an inner cavity for accommodating a ring; a back that closes off said cavity; and assembly means for securing said ring to said unit; securing means for securing said back to said ring; wherein said assembly means comprises a deformable gasket disposed along said inner surface of said side portion, and an assembly member, disposed between said inner surface and said ring, projecting, at least in part, into the cavity and generating, in cooperation with said ring, a radial deformation on said gasket to thereby compress said gasket against said inner surface and secure said ring to said unit.

9. A watch case as in claim 8, wherein said ring is disposed in the cavity to leave a free space between said ring and said inner surface, said ring having a centering flange bearing on said inner surface and forming a bearing for the gasket, and wherein said assembly member comprises an annulus, disposed in said free space and having a radially outer surface formed with a bevel on a portion thereof nearest the gasket, to compress said gasket on the one hand against said inner surface and on the other hand against said flange.

10. A watch case as in claim 8, wherein said gasket is a sealing gasket.

11. A watch case as in claim 10, further comprising a sealing gasket between the back and the ring.

12. A watch case as in claim 8, wherein the middle cum glass unit is a single part made of pressed mineral glass.

13. A watch case as in claim 8, wherein said inner surface has a circumferential groove for receiving said deformable gasket.

14. A watch case as in claim 8, wherein the means for securing the back to the ring include at least one screw.

* * * * *